United States Patent [19]

Lorenz et al.

[11] 4,456,536

[45] Jun. 26, 1984

[54] SKIMMER APPARATUS FOR RECOVERING BITUMEN

[75] Inventors: Gordon Lorenz, Edmonton; Ken Gehring, Sherwood Park, both of Canada

[73] Assignees: Petro-Canada Exploration Inc., Calgary; Her Majesty the Queen in right of the Province of Alberta, Government of the Province of Alberta, Department of Energy and Natural Resources, Edmonton; PanCanadian Petroleum Limited, Calgary; Esso Resources Canada Ltd., Calgary; Canada-Cities Service, Ltd., Calgary; Gulf Canada Resources Inc., Calgary; Alberta Energy Company Ltd., Calgary; Hudson's Bay Oil and Gas Company Limited, Calgary; Petrofina Canada Inc., Calgary, all of Canada; a part interest

[21] Appl. No.: 282,213

[22] Filed: Jul. 10, 1981

Related U.S. Application Data

[63] Continuation of Ser. No. 116,818, Jan. 29, 1980, abandoned.

[51] Int. Cl.[3] ..... E02B 15/04

[52] U.S. Cl. ..... 210/776; 210/242.3; 210/923

[58] Field of Search ..... 210/765, 776, 923, 242.3, 210/924, 767, 608; 198/518, 668

[56] References Cited

U.S. PATENT DOCUMENTS

| | | | |
|---|---|---|---|
| 3,536,199 | 10/1970 | Cornelius | 210/776 |
| 3,539,048 | 11/1970 | Person | 210/242 S |
| 3,608,728 | 9/1971 | Trimble | 210/DIG. 25 |
| 3,613,891 | 10/1970 | Cloutier | 210/DIG. 25 |
| 3,623,609 | 11/1971 | Ainlay | 210/242 S |
| 3,693,805 | 9/1972 | Tillet | 210/DIG. 25 |
| 3,700,108 | 10/1972 | Richards | 210/DIG. 25 |
| 3,702,297 | 11/1972 | Maksim | 210/DIG. 25 |
| 3,804,251 | 4/1974 | Farell et al. | 210/DIG. 25 |
| 3,968,041 | 7/1976 | DeVoss | 210/242 S |
| 4,336,137 | 6/1982 | Byers | 210/242.3 |

FOREIGN PATENT DOCUMENTS

| | | | |
|---|---|---|---|
| WO79/01135 | 12/1979 | European Pat. Off. | 210/242 S |
| 2757859 | 2/1979 | Fed. Rep. of Germany | 210/242.2 |

OTHER PUBLICATIONS

Hackh's Chemical Dictionary, 4th Edition Julius Grant, McGraw Hill, New York 1969, p. 101.

*Primary Examiner*—Peter A. Hruskoci
*Assistant Examiner*—Sharon T. Cohen
*Attorney, Agent, or Firm*—Millen & White

[57] ABSTRACT

Bitumen, floating on tailings pond water in the form of a cohesive blanket, is recovered from the surface by an apparatus that takes advantage of the cohesiveness of the bitumen. A drum with radially attached prongs is partly submerged in the water and is rotated around its longitudinal axis so that the prongs penetrate into the bitumen blanket and grip and pull it towards the drum. Upon being drawn by the prongs beneath the surface of the water, hydrostatic pressure causes the bitumen to adhere to the curved surface of the drum. During the upswing of the drum, the prongs and the adhesiveness of the metal surface of the drum hold the bitumen on the drum. A comb scraper then removes the greater portion of the bitumen, which falls into a receptacle.

2 Claims, 3 Drawing Figures

SKIMMER APPARATUS FOR RECOVERING BITUMEN

This is a continuation, of application Ser. No. 116,818 filed Jan. 29, 1980, now abandoned.

FIELD OF THE INVENTION

This invention relates to an apparatus and a process for recovering bitumen floating on the surface of a body of water, such as a tailings pond. More particularly, it has reference to the field of oil skimmers and to the processes practiced by them.

BACKGROUND OF THE INVENTION

Tar sands (also known as oil or bituminous sands) are an extensive source of hydrocarbons which in recent years have become economically viable. There are two commercial plants presently operating in the Alberta tar sands; the first produces approximately 50,000 barrels of synthetic crude/day, the second about 130,000 barrels/-day. This second plant, owned by the assignees of this invention, is hereafter referred to as 'the aforementioned plant'.

Both these plants use an extraction process known as the 'hot water process'. This process is well described in the literature (for example, see Canadian Pat. No. 1,055,868).

The hot water process produces a waste stream, called "tailings", which is a mixture of solids, water and some bitumen. The solids comprise a coarse sand fraction and a fines fraction usually described as being $-44\mu$ clay and silt particles.

The volume of this waste stream is very large. In the aforementioned plant, dry tar sand feed enters the process at a rate of about 13,000 tons/hour and tailings leave at a rate of about 20,000 tons/hour.

The plant design analysis of the aforementioned plant specifies that the bitumen content of the tailings should be about 0.49% by weight. However the actual content varies widely depending on whether the tar sand feed is high or low grade. Bitumen losses by way of the tailings increase as the fines content of the tar sand feed increases. Bitumen losses with the tailings at the aforementioned plant have been known to run as high as 11,000 barrels/day when it was processing high fines feed.

The tailings are discarded from the extraction plant into a tailings pond. In the case of the 130,000 barrel/-day plant, this pond will eventually cover about 10 square miles. The bitumen, while constituting an undesirable process loss, also is a serious environmental problem—because it floats on the surface of this large body of water, it can coat wild fowl landing in it.

Clearly it would be desirable to contain the bitumen within booms and recover it using an oil skimmer. However, several types of commercially available skimmers have been tried with poor results. This failure is attributable to the peculiar nature of the bitumen.

More particularly, bitumen is a particularly viscous material. At 10° C., its viscosity is in the order of 2,000,000 centistokes; at 20° C. it is in the order of 200,000 centistokes. By way of comparison, crude oil and bunker oil at 20° C. have viscosities in the order of 300 and 1000 centistokes respectively.

When the hot bitumen discharged by the extraction plant contacts the cold water of the tailings pond, its lower most portion forms into a cohesive stiff layer which supports an uppermost portion having a butter-like consistency. This mass is hereinafter referred to as a bitumen blanket.

When existing commercially available oil skimmers were applied to the bitumen blanket, it was found that, instead of picking the bitumen up, the rotating discs, drums and conveyor belts of these units would tend to ride up onto the blanket and pass it beneath them. The machines also tended to break the blanket up without picking up the bitumen. Finally, some of them would tend to clog up with the bitumen.

With the foregoing in mind, it was therefore the object of this invention to devise a machine which would successfully recover a bitumen blanket floating on the surface of a body of water.

SUMMARY OF THE INVENTION

In accordance with the invention, a skimming apparatus is provided which operates on the principle of gripping and moving the blanket as an integral unit onto the drum. The apparatus includes a drum assembly comprising a slowly rotating drum having outwardly extending rigid prongs protruding from its curved surface. These prongs function to penetrate and grip the nearest part of the blanket and then, as they are moved by rotation of the drum to which they are anchored, they draw the blanket into adhesive contact with the drum's outer surface. The drum is partly submerged and rotates in a counter-clockwise direction so as to force the engaged part of the blanket beneath it. Thus the engaged part of the blanket is drawn down beneath the surface of the water. The combination of hydraulic head, acting to press the bitumen against the lowermost curved surface of the drum, and penetration into the blanket by the prongs causes the bitumen to become affixed to the drum. Further rotation of the drum results in this bitumen being lifted rearwardly and upwardly clear of the water. Means, such as a flexible comb-like doctor blade, remove the bitumen from the drum assembly. A receptacle collects the bitumen as it is scraped off. Means, such as an auger, may then be used to transfer collected bitumen from the receptacle to a container, such as a barge, which conveys the viscous material to shore. Here it may be rendered pumpable by dilution with light hydrocarbon and returned to the extraction plant or may be otherwise treated.

Broadly stated, the invention is a skimming apparatus for collecting a cohesive bitumen blanket floating on a body of water, said blanket having a lowermost portion which is stiffer than its uppermost portion due to cooling by the water, said apparatus comprising: buoyant means for floating on the water and carrying the other components of the apparatus; a drum assembly carried by the buoyant means and comprising a horizontally disposed drum arranged to be partly submerged in the water when operative and to rotate in a counter-clockwise direction, said drum having a plurality of spaced apart, outwardly protruding rigid prongs distributed over and extending from its curved surface, said prongs being operative, when the drum is rotating, to penetrate through the uppermost portion and grip the lowermost portion of the nearest part of the blanket to thereby pull that part into submerged adhesive engagement with the lower surface of the drum; means carried by the buoyant means for removing bitumen from the drum after it has emerged from the water; a receptacle for collecting the removed bitumen; and means for rotating the drum.

In another aspect of the invention, a process is provided for collecting part or all of a cohesive bitumen blanket floating on a body of water with a skimming apparatus as set forth in claim 6, the drum of said apparatus being partly submerged in the water and in contact with the blanket, comprising: gripping the nearest part of the blanket by penetrating it with the prongs of the rotating partly submerged drum and pulling said nearest part beneath the surface of the water into adhesive contact with the outer surface of the submerged portion of the drum, said rotation being sufficiently slow whereby the blanket does not tear but instead follows and remains integral with said part; carrying adhering bitumen upwardly out of the water on the drum; recovering adhering bitumen from the drum; and continuing said steps to gradually collect part or all of the blanket.

DESCRIPTION OF THE PREFERRED EMBODIMENT

Figure 1:
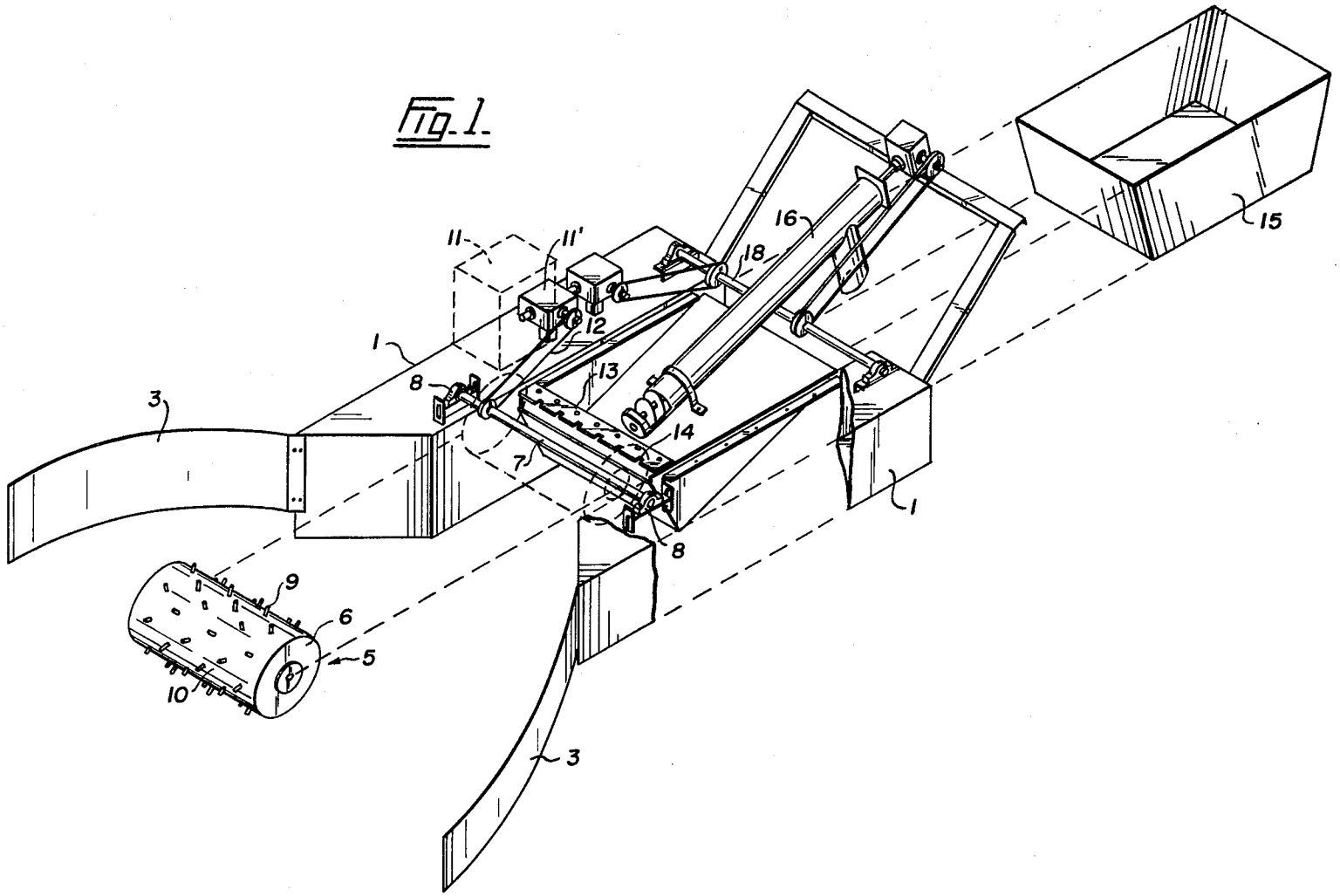
FIG. 1 is a partly exploded perspective view of the skimming apparatus.
Figure 2:
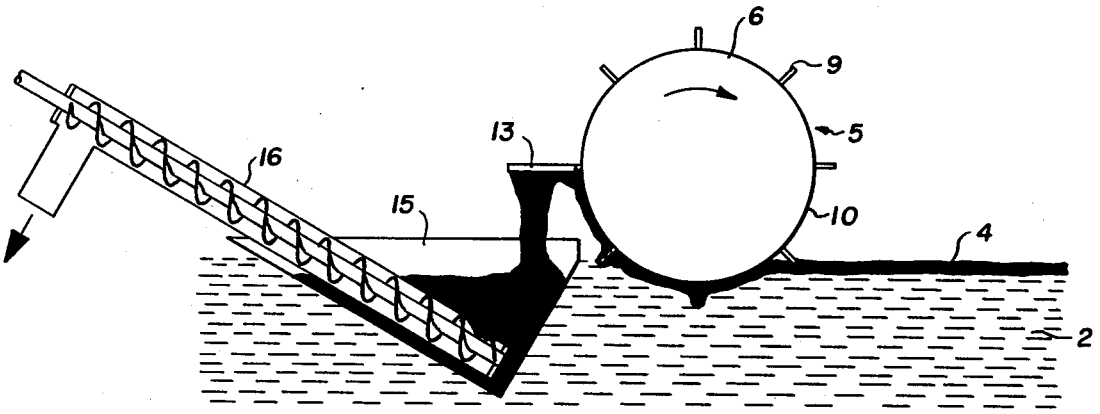
FIG. 2 is a simplified diagrammatic side view showing the apparatus in operation.
Figure 3:
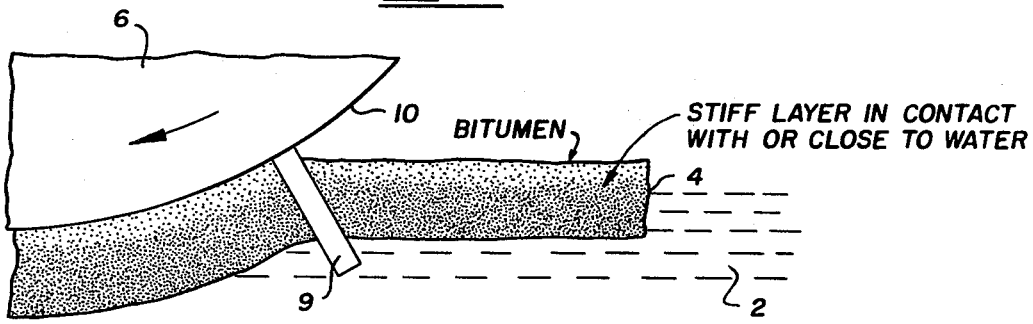
FIG. 3 is a fanciful representation of a side section of a bitumen blanket as commonly encountered on the tailings pond. A prong is shown gripping the blanket by penetrating it. The blanket is shown adhering to the drum. The shading identifies the cohesive, stiff portion.

With reference now to the drawing, the apparatus comprises a pair of buoyant, spaced, parallel pontoons 1 which float on the pond water 2 and carry the other components.

A pair of guide members 3 may be provided to extend forwardly and outwardly from the pontoons 1. A floating boom, not shown, will extend laterally from each guide member 3 to contain the bitumen blanket 4.

A drum assembly 5, comprising a drum 6 having a horizontal drive shaft 7, is mounted for rotation in bearings 8 carried by the pontoons 1. A plurality of prongs 9 are anchored to the drum 6 and extend outwardly from its curved surface 10. In the prototype unit, the drum 6 was a common 45 gallon steel drum having ¼"×2" steel prongs attached thereto.

While only a steel drum has been tested, it is anticipated that other rotating curved endless members, such as a conveyor belt, could be used. Also, while only steel prongs have been used, it is anticipated that other tooth-like members, capable of penetrating through the entire bitumen blanket, could also function satisfactorily.

Means are provided for rotating the drum assembly 5. As shown, such means may comprise a motor 10 driving the drum shaft 7 through a gear reducer 11 and belt 12.

Means are provided to the rear of the drum assembly 5 for scraping bitumen from it. Such means may comprise a comb-like doctor blade 13 made of stiff rubber. The openings 14 of the blade 13 are aligned with the rows of prongs 9 to scrape excess bitumen from them.

A receptacle or open-topped container 15 is provided beneath the doctor blade 13 to catch bitumen being scraped from it.

An auger 16 may be provided to transfer the bitumen from the receptacle 15 into a barge for transfer to shore. The auger 16 is conveniently driven by the motor 10 through a suitable gear reducer-belt-shaft system 18.

In use, the drum 6 is partly submerged in the water.

A key feature of the invention is that the prongs 9 must penetrate the bitumen blanket 4 and take a grip on it. If the drum 6 is rotated slowly, so as not to tear the blanket, the entire blanket will bit by bit be drawn down and onto the lowermost submerged surface of the drum. The combination of prong penetration and adhesion of the bitumen to the oily surface of the drum is such that the drum assembly 5 will carry the attached part of the blanket up out of the water to a level where it may be scraped off.

Care has to be taken to operate the drum assembly 5 slowly enough so as not to tear the blanket. This speed will of course vary with the size of the drum, the temperature of the water and other factors. We found that with a drum having a diameter of 560 mm operating in a blanket having a thickness of 30 mm, an r.p.m. of 6 was suitable-if the r.p.m. was increased to about 12, tearing would occur 200–500 mm forward of the drum. Even so the paddle effect of the prongs tends to push the water to the rear thereby pulling the bitumen blanket again to the rotating drum.

The embodiments of the invention in which an exclusive property or privilege is claimed are defined as follows:

1. A skimming apparatus for collecting a cohesive bitumen blanket floating on a body of water, said blanket having a lowermost portion which is stiffer than its uppermost portion due to cooling by the water, said apparatus comprising:

buoyant means for floating said apparatus on the water;

a drum assembly carried by the buoyant means and comprising a horizontally disposed drum arranged to be partly submerged in the water when operative and to rotate in a direction such that its frontal edge rotates downwardly into the water, said drum having a plurality of spaced apart outwardly protruding rigid prongs distributed over substantially its entire curved surface and extending from said surface, said prongs being of sufficient length and arranged to penetrate through the uppermost portion and grip the lowermost portion of the nearest part of the blanket to thereby pull that part into submerged adhesive engagement with the lower surface of the drum when the drum is rotating;

means, carried by the buoyant means, for removing bitumen from the drum after it has emerged from the water;

a receptacle for collecting the removed bitumen; and means for rotating the drum.

2. A process for collecting part or all of a cohesive bitumen blanket floating on a body of water with a skimming apparatus, said apparatus comprising a rotatable drum having outwardly protruding prongs distributed over its curved surface, said blanket having a lowermost portion which is stiffer than its uppermost portion due to cooling by the water, the drum of said apparatus being partly submerged in the water and in contact with the blanket by buoyant means for floating said apparatus on the water, said process comprising:

rotating the drum in a direction such that its frontal edge rotates downwardly into said bitumen blanket;

gripping the nearest part of the blanket by penetrating it with the prongs of the rotating partly submerged drum, to a sufficient depth so that said prongs grip the lowermost portion, and pulling said nearest part beneath the surface of the water into adhesive contact with the curved outer surface of the submerged portion of the drum, said rotation being sufficiently slow whereby the blanket does not tear but instead follows and remains integral with said part;

carrying adhering bitumen upwardly out of the water on the drum;

recovering adhering bitumen from the drum;

and continuing said steps to gradually collect part or all of the blanket.

* * * * *